United States Patent [19]

Marxer

[11] Patent Number: 4,720,926

[45] Date of Patent: Jan. 26, 1988

[54] SKI BOOT

[75] Inventor: Herbert Marxer, Schaan, Liechtenstein

[73] Assignee: Lange International S.A., Fribourg, Switzerland

[21] Appl. No.: 913,700

[22] Filed: Sep. 30, 1986

[30] Foreign Application Priority Data

Jan. 17, 1986 [CH] Switzerland ..... 174/86

[51] Int. Cl.[4] ..... A43B 5/04; A43B 23/28

[52] U.S. Cl. ..... 36/117; 36/58.5; 36/120

[58] Field of Search ..... 36/117–121, 36/58.5, 71, 93, 88

[56] References Cited

U.S. PATENT DOCUMENTS 4,265,034 5/1981 Salomon ..... 36/121
4,447,970 5/1984 Delery ..... 36/121
4,519,150 5/1985 Arieh et al. ..... 36/121
4,551,933 11/1985 Morrell et al. ..... 36/120

FOREIGN PATENT DOCUMENTS 1111063 7/1961 Fed. Rep. of Germany ..... 36/117
3045928 9/1981 Fed. Rep. of Germany ..... 36/117
10054 of 1913 United Kingdom ..... 36/58.5

*Primary Examiner*—James Kee Chi
*Attorney, Agent, or Firm*—Brumbaugh, Graves, Donohue & Raymond

[57] ABSTRACT

The boot is composed of a lower shell (1), on which an upper (2) is articulated about a pivot axis (5) coinciding at least approximately with the joint of the foot. The shell (1) has on the outside, at the rear, a rounded portion (12), the radius of curvature of which is centered on the pivot axis, (5), to allow the upper (2) to tilt to the rear. Means, such as ribs (17), are provided inside the part (11) of the shell in order to limit the space intended for receiving the skier's heel.

7 Claims, 12 Drawing Figures

SKI BOOT

FIELD OF THE INVENTION

The present invention relates to a ski boot composed of a lower shell comprising the sole and vamp and surrounding the heel, and of an upper in one or two parts, which is articulated on this lower shell at two points coinciding at least approximately with the joint of the user's foot and covering the upper edge of the said lower shell surrounding the heel.

PRIOR ART

A distiinction is made essentially between two types of boots with a shell made of synthetic material, according to the way in which they are fitted on. Boots of the first type, called top-fitting boots, have a onepiece upper closed at the front, as described, for example in Swiss Patent No. 549,970. Boots of the second type, called rear-fitting boots, have an upper composed of a front part and a rear part which fits into the front part to surround the skier's foot, and which can be turned down to the rear in order to put on the boot as described, for example, in French Patent No. 2,428,413.

In boots of the first type, as emerges clearly from FIG. 2 of Swiss Pat. No. 549,970 it is not possible for the upper to tilt to the rear about the pivot axis passing through the malleoli, since the upper immediately comes up against the rear of the lower shell. To allow slight tilting to the rear, a space would have to be left between the upper and the lower shell, and this space would allow snow to penetrate inside the shell. Such a space is therefore unacceptable, and on the contrary it is necessary, if possible, to ensure permanent contact between the upper and the lower shell.

In boots of the second type, put on from the rear, the rear part of the upper can tilt rearwards, since its pivot axis coinciding with the pivot axis of the upper is arranged below the joint of the skier's foot. However, such a pivoting of the upper is inappropriate for skiing, since it does not correspond to the natural articulation of the foot and exerts pressure on the heel during forward bending. Furthermore, the difference between the pivot axis of the upper of the boot and the joint of the skier's foot produces, when the leg is bent, a linear contact zone round the tibial support of the leg.

It has already been proposed to overcome these deficiencies by articulating the rear part of the upper on the front part and not on the upper shell, and by articulating the front part ont he shell about a second pivot axis coinciding with the joint of the skier's foot. In the closed position, the boot is then equivalent to a boot of the first type with the same disadvantage, that is to say the impossibility of tilting to the rear, so that the upper, even when freed from constraint, does not allow normal walking, with or without a ski. There has also been a proposal to rectify the defect of the tibial support in a rear-fitting boot by mounting an articulated pressure distribution plate in the front top part of the upper (FR-A-2,506,135).

The object of the invention is to allow the upper of the boot not only to straighten up in the free position, but also to tilt to the rear at a relatively large angle, whilst at the same time being articulated about an axis coinciding with the joint of the skier's foot.

This has two advantages: the first, for a boot of the first type, is to make it easier to put on the boot by turning the one-piece upper down to the rear as far as it will go, in such a way that the top-fitting boot for all practical purposes becomes a rear-fitting boot; the second advantage is to make skiing easier by means of the two types of boot, particularly when skiing downhill, by making it possible for the upper to follow the natural pivoting of the foot.

SUMMARY OF THE INVENTION

To achieve this, the boot according to the invention has the characteristics defined in claim 1.

What seemed impossible because of the shape of the foot and the position of its joint which determine the shape of the rear of the boot shell has been made possible by extending the shell beyond the profile defined by the shape of the heel, that is to say, as it were, by tinkering with the natural shape which seemed obligatory.

An obstacle to this measure, where a boot made of injection-molded synthetic material is concerned, might seem to be a considerable extra thickness of the shell in the region of the heel. This obstacle can be removed by means of suitable measures, for example by providing, inside the shell of conventional thickness, ribs which are directed forwards and the edges of which limit and define the space provided for the skier's heel, or by means of cells or double wall or even by means of an attached filling piece.

BRIEF DESCRIPTION OF THE DRAWINGS

The accompanying drawing illustrates some embodiments of the invention by way of example.

DESCRIPTION OF THE PREFERRED EMBODIMENTS

Figure 1:
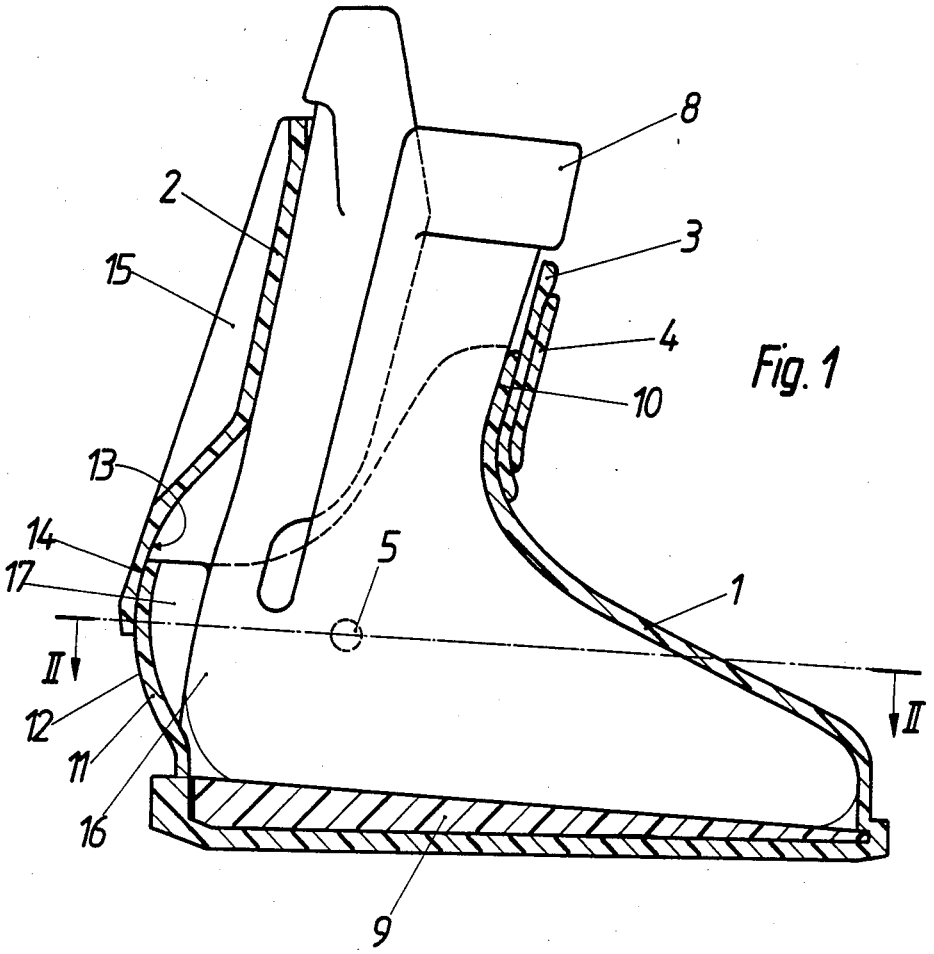
FIG. 1 is a view, in vertical section according to I—I of FIG. 2, of a boot according to a first embodiment in the tight-closed position.
Figure 2:
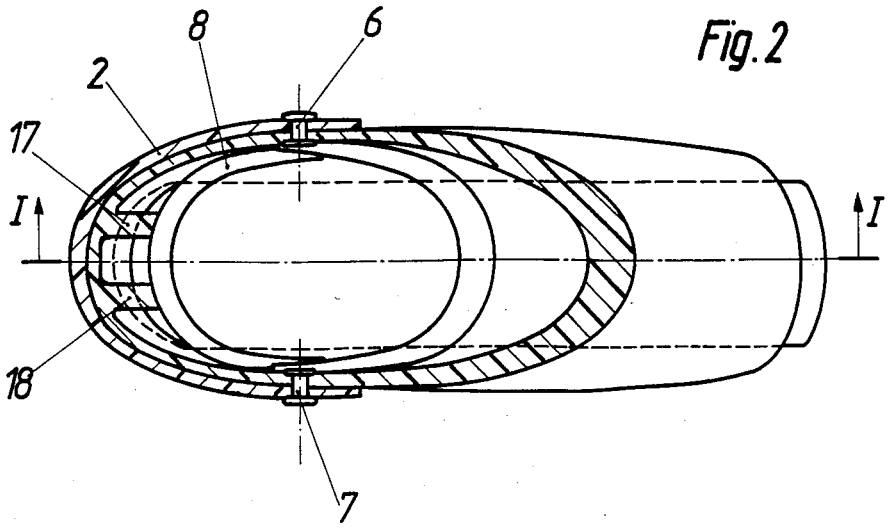
FIG. 2 is a view in approximately horizontal section according to II—II of FIG. 1.
Figure 3:
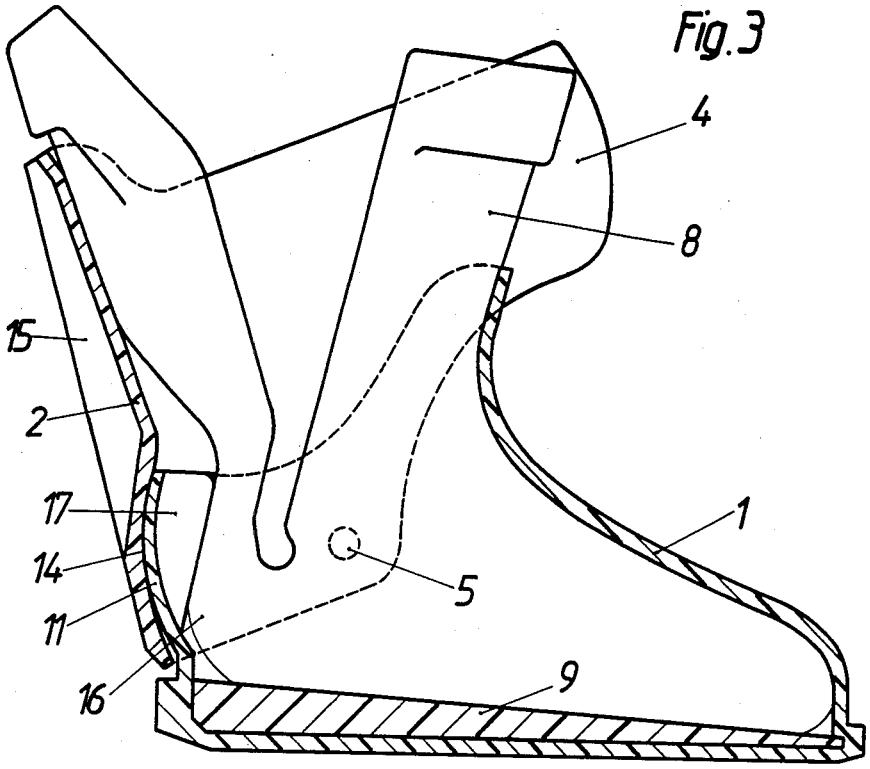
FIG. 3 is a sectional view similar to that of FIG. 1, with the boot in the open position and the upper turned down to the rear.
Figure 8:
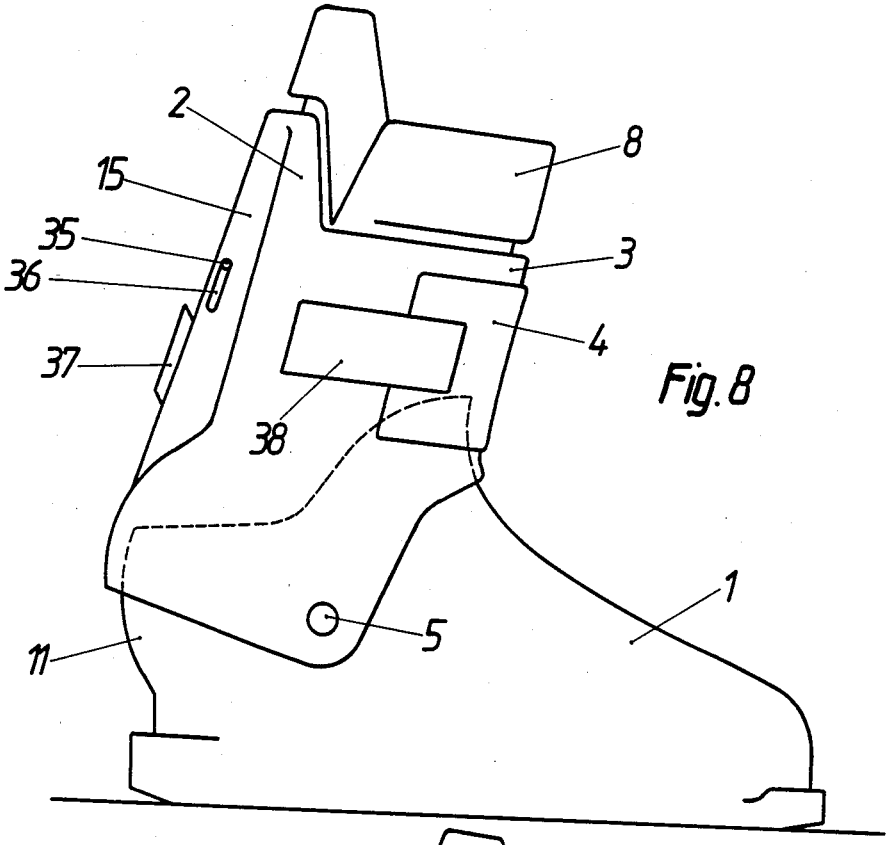
FIG. 8 shows another embodiment of a boot according to the invention, equipped to the rear with means of locking the upper in a position inclined forwards for skiing.
Figure 9:
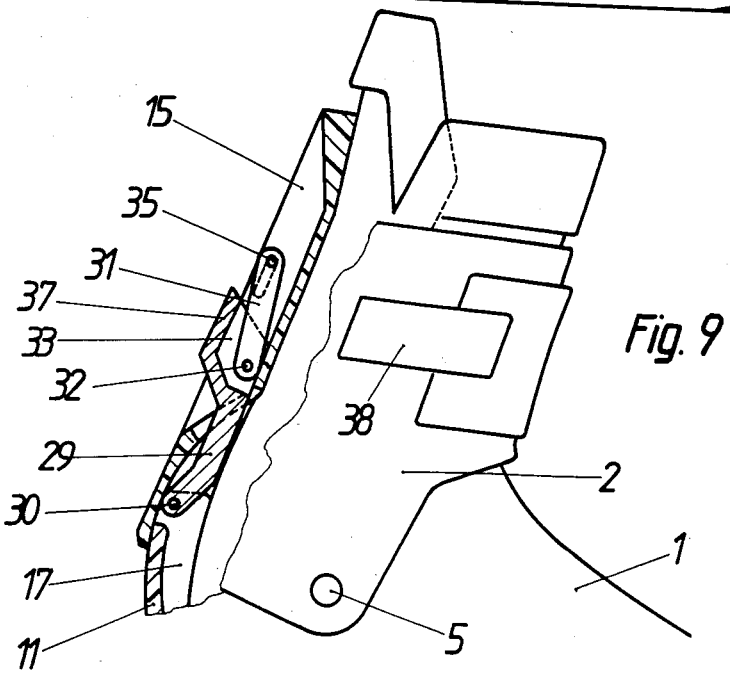
FIG. 9 is a sectional view of the locking means of the boot shown in FIG. 8.

The boot illustrated in FIGS. 1 to 3 comprises a shell 1 made of molded synthetic material, this shell 1 comprising the sole and vamp of the boot and surrounding the heel. Articulated on this shell 1 is a one-piece upper 2 equipped at the front with two tabs 3 and 4 which are turned down onto one another to close the upper, this closed position being maintained by all suitable means, for example a buckle, as shown in FIG. 8. The upper 2 surrounds the top part of the shell 1 both at the front, above the instep and at the rear round the heel. The upper 2 is articulated on the shell 1 about an axis 5, corresponding at least approximately to the joint axis of the skier's foot, by means of two riveted metal pins 6 and 7. The interior of the boot contains a sock 8 and a wedge 9 forming a plantar support which gives the foot a certain forward inclination relative to the sole. In this embodiment, the front top part 10 of the shell 1 rises relatively high, so that when the upper is closed and tightened it can tilt to the rear only with great difficulty.

The rear part 11 of the shell surrounding the heel has, on the outside, a rounded surface 12 which extends over most of the height of the shell and of which the radius of curvature of the verical section shown in FIG. 1 is centered on the pivot axis 5 of the upper 2. At the same location on the heel, the upper 2 also has a rounded inner surface 13, of which the vertical section shown in FIG. 1 has a radius of curvature likewise centered on the pivot axis 5 and equal to the radius of curvature of the surface 12 of the shell. Furthermore, on either side of the vertical sectional plane of FIG. 1, the surfaces 12 and 13 coincide with one another and are contiguous. The rounded inner surface 13 continues the surface 12 of the shell above the heel and extends as far as the sock, where it is joined to a virtually cylindrical surface contiguous with the sock 8. In this region, the rigidity of the upper is ensured by means of two vertical ribs 15. It will be seen from FIG. 1 that the heel 11 of the shell 1 does not correspond to the heel 16 of the sock 8, that is to say to the position of the skier's heel, but there is relatively large space between the heel 16 of the sock and the heel 11 of the shell. Because it is essential for the skier's heel to be firmly retained at the rear in the boot, this space must be filled. In the first embodiment illustrated in FIGS. 1 to 3, this space is occupied by two vertical ribs 17 and 18 molded integrally with the shell and extending forwards, the front edges of these ribs 17 and 18 defining the envelope of the bearing surface of the heel 16 of the sock.

When the boot is opened by releasing the tabs 3 and 4 of the upper 2 from one another, as shown in FIG. 3, it will be seen that the upper 2 can tilt relatively far to the rear because the outer surface 12 of the shell and the inner surface 13 of the upper 2 coincide. Furthermore, in all the positions of the upper 2 in relation to the shell 1, the surfaces 12 and 13 are contiguous over a relatively large joining surface 14 in all the positions of the upper relative to the shell, thus ensuring good sealing of the boot. In the extreme rear tilting position shown in FIG. 3, the back part of the upper is practically turned down to the rear as much as in a rearfitting boot of known design, whereas the boot illustrated is designed as a top-fitting boot, the result of which is that it becomes much easier to put on the boot. To close the boot, it is sufficient to push back the upper 2 forwards and close the buckle provided on this upper. The boot can, of course, include additional means for the tight-fitting of the foot, for example known tightening means arranged inside the shell on the instep between the sock and the shell.

Figure 4:
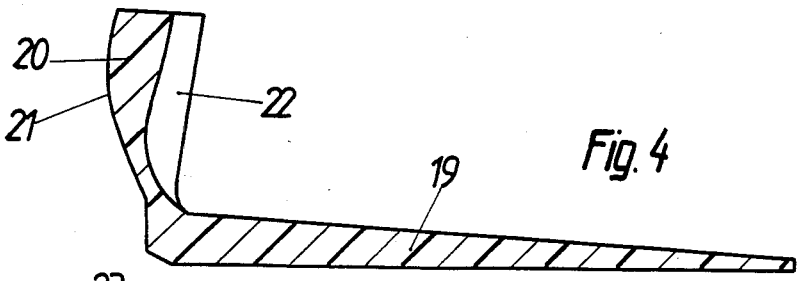
FIG. 4 shows a view in longitudinal vertical section of a plantar support used as a first alternative embodiment of means provided to limit the space at the rear of the skier's heel.

Other means can be provided to fill the space between the heel 16 of the sock 8 and the rear 11 of the shell. For example, as shown in FIG. 4, the plantar support 19 similar to the plantar support 9 can be provided with a vertically extending back part 20 which has, on one side, a surface 21 matching the inner surface of the part 11 of the shell and, on the other side, a surface 22 forming a suitable receptacle for the sock 16, that is to say the skier's heel.

Figures 5, 6, 7:
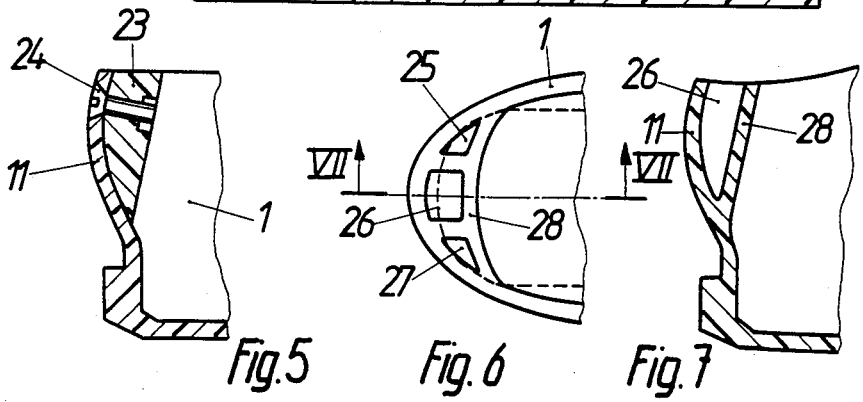
FIG. 5 is a partial view, in vertical and longitudinal section, of a second alternative form of these limiting means.
FIG. 6 is a plan view of the rear part of the shell, showing a third alternative embodiment of the said limiting means.
FIG. 7 is a partial view, in longitudinal vertical section, showing a fourth alternative embodiment of the said limiting means.

According to another embodiment illustrated in FIG. 5, the space is occupied by an attached piece 23, preferably made of plastic, which is fastened to the part 11 of the shell 1 by means of a screw 24.

According to another embodiment illustrated in FIGS. 6 and 7, cells 25, 26 and 27 are formed in an extra thickness of the shell during molding, so as to leave an inner wall 28. This structure is both light and rigid.

The space between the outer wall 11 of the shell 1 and the heel 16 of the sock, particularly the ribs 17 and 18 and the reinforcing ribs 15 of the upper 2, can be advantageously used to fit a mechanism for controlling the rearward or forward tilting of the upper and for locking the upper in the closing position during skiing. Such a mechanism is shown in FIGS. 8 to 12. This mechanism is a toggle mechanism composed of a lever 29 articulated at its lower end about a pivot pin 30 mounted between and in the ribs 17 and 18 of the shell, and of a link 31 articulated at an intermediate point of the lever 29 by means of a pivot pin 32 mounted between two cheeks 33 and 34 of the lever 29 (FIG. 12) and, at its other end, between and in the two reinforcing ribs 15 of the upper 2 by means of a pivot pin 35 capable of moving in slots 36 extending in the same direction as the ribs 15. The lever 29 has a U-shaped actuating end 37 comprising the cheeks 33 and 34 and covering the pivot pin 32. In the position locking the upper forwards, the pivot pin 32 is located between the straight line joining the pins 30 and 35 and the wall of the upper 2. The pin 35 bears with pressure against the top end of the slots 36. In the closed position for skiing, shown in FIGS. 8 and 9, the upper is maintained in the forward position by the mechanism described. Moreover, the upper is closed by means of a conventional buckle 38 connecting the tab 4 to the side of the upper 2. When the leg is bent, the upper 2 can pivot forwards because of the slot 36 which is calculated to allow sufficient play for bending. The elastic resistance to forward bending can be ensured by means of the actual material of the shell 1 and of the upper 2 or by auxilliary elastic means located on the instep between the upper and the shell or arranged in the toggle.

Figure 10:
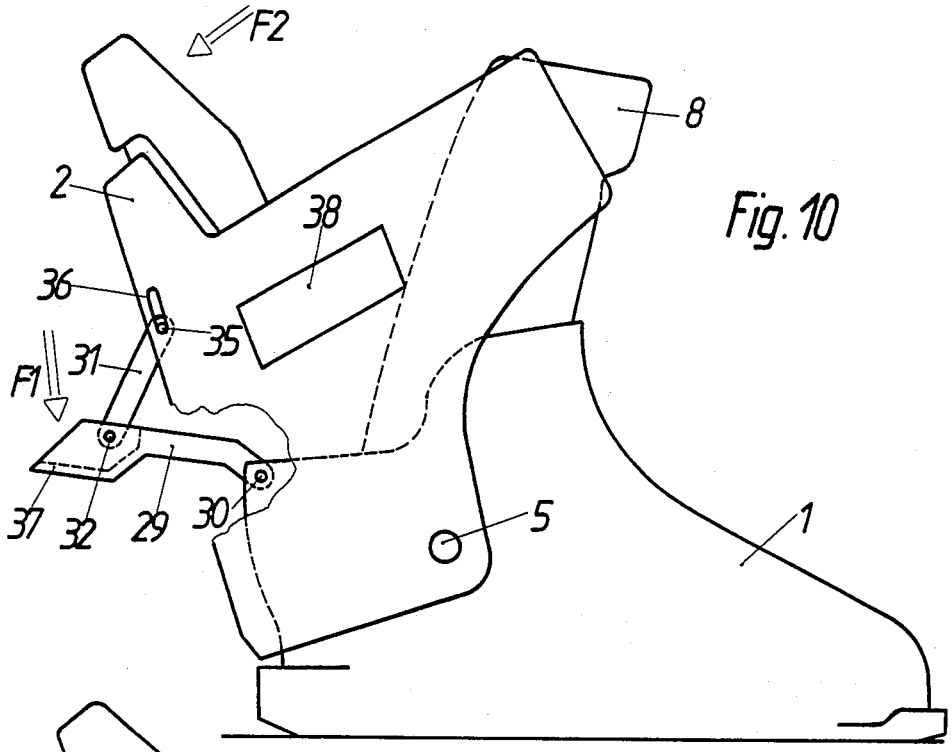
FIG. 10 shows the same boot during opening, in the maximum opening position.

When the skier wishes to take off his boot, he pulls on the end 37 of the lever 29 in the direction of the arrow F1, FIG. 10. Because of the non-alignment of the pins 30, 32 and 35, this pull first tends to move the pins 30 and 35 away from one another. If the buckle 38 is still closed and tensioned, the user encounters some resistance, but the elasticity of the boot enables him immediately to pass the point of alignment and open the mechanism. This happens when the skier does not want to take off the boot, but simply release the articulation of the upper 2 to allow comfortable standing or walking. If, on the other hand, the buckle 38 is previously opened, the user encounters only frictional resistance. It can be seen from FIG. 10 that the upper 2 pivots widely to the rear in the direction of the arrow F2, thus making it easy to remove the foot from the boot.

Figure 11:
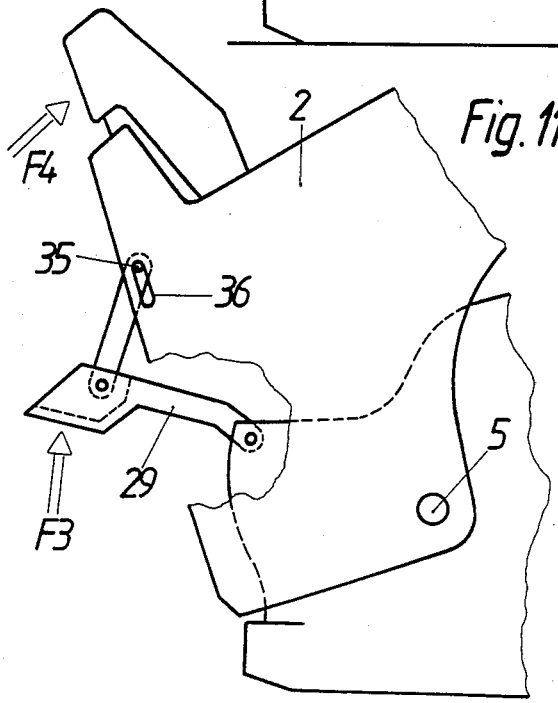
FIG. 11 partially shows the same boot at the start of closing by means of the closing and locking device.
Figure 12:
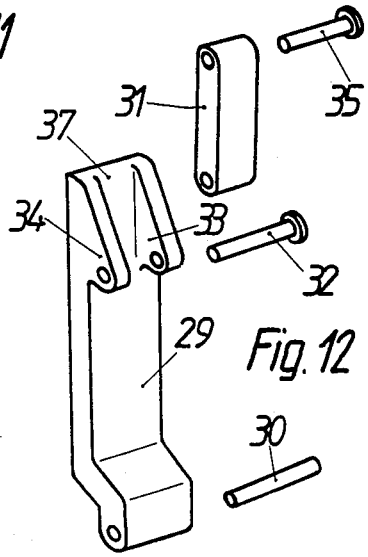
FIG. 12 is an exploded perspective view of the locking mechanism.

Conversely, when the boot is put on, the skier can easily insert his foot into the boot in the position shown in FIG. 10, and he then presses on the lever 29 in the direction of the arrow F3, FIG. 11, the effect of which is to pivot the upper 2 about the axis 5 in the direction of the arrow F4 when the pin 35 reaches the upper end of the slots 36.

It would, of course, be directly possible to articulate the lower end of the lever 29 on the attached piece 23 of FIG. 5 or in the cell 26 FIGS. 6 and 7 or in the extension 20 of the plantar support 19. As regards the attached piece 23 and the part 20 of the plantar support, it is sufficient to provide a horizontal groove to accommodate the lower end of the lever 29. It will also be noted that the articulation of the toggle on the boot does not require any auxilliary metal component.

The boots described above and illustrated in the drawing have a one-piece upper. However, the upper could also be in two pieces, as in known boots called rear-fitting boots. In this case, the rear part of the upper can be produced in exactly the same way as the rear part of the upper 2 illustrated, and it can likewise receive the end of a toggle mechanism, such as that illustrated.

I claim:

1. A ski boot composed of a lower shell (1) comprising the sole and the vamp and surrounding the heel and of an upper (2) in one or two parts, articulated on this lower shell at two points (6, 7) coinciding at least approximately with the joint of the user's foot and covering the top edge of the said lower shell surrounding the heel, wherein the said lower shell (1) has on the outside, at the rear, a rounded portion (12) which extends over most of the height of the shell and of which the radius of curvature of the vertical mid-section is centered on the axis (5) passing through the pivot points (6, 7) of the upper, and where the inner surface (13) of the lower back part of the upper has a rounded portion similar to the said rounded portion (12) of the shell and of the same radius likewise centered on the pivot axis of the upper, means (17, 18; 20; 23; 28) being provided inside the rounded part (11) of the shell to limit, at the rear, the space intended for receiving the skier's heel.

2. The boot as claimed in claim 1, wherein the means provided for limiting the space intended for receiving the skier's heel are formed by the edges of at least two ribs (17, 18) directed towards the front of the boot.

3. The boot as claimed in claim 1, wherein the means provided for limiting the space intended for receiving the skier's heel are formed by an attached piece (23).

4. The boot as claimed in claim 1, wherein the means provided for limiting the space intended for receiving the skier's heel are formed by a cellular extra thickness (25, 26, 27, 28).

5. The boot as claimed in claim 1, having a plantar support, wherein the means provided for limiting the space intended for receiving the skier's heel are formed by a bent part (20) of the plantar support (19).

6. The boot as claimed in one of claims 1 to 5, wherein the said means provided for limiting the space intended for receiving the skier's heel support the pivot pin (30) of one of the parts (29) of a toggle mechanism (29, 31), the other part (31) of which is articulated on the upper (2), this toggle serving for tilting the upper and locking it in a a position inclined forwards for skiing.

7. The boot as claimed in claim 6, wherein the back part of the upper has two parallel vertical stiffening ribs (15), and wherein the pivot pin (35) of the said other part (31) of the toggle is mounted between these ribs in slots (36) substantially parallel to the upper.

* * * * *